US009468963B2

(12) United States Patent
Fries et al.

(10) Patent No.: US 9,468,963 B2
(45) Date of Patent: Oct. 18, 2016

(54) BENDING HEAD FOR BENDING ROD- AND PIPE-SHAPED WORKPIECES

(75) Inventors: Stefan Fries, Reutlingen (DE); Jörg Möck, Sonnenbühl (DE); Frank Weiblen, Metzingen-Neuhausen (DE); Carina Baier, Pfronstetten (DE)

(73) Assignee: WAFIOS AKTIENGESELLSCHAFT, Reutlingen (DE)

( * ) Notice: Subject to any disclaimer, the term of this patent is extended or adjusted under 35 U.S.C. 154(b) by 297 days.

(21) Appl. No.: 14/003,228

(22) PCT Filed: Jan. 13, 2012

(86) PCT No.: PCT/EP2012/000144

§ 371 (c)(1),
(2), (4) Date: Sep. 4, 2013

(87) PCT Pub. No.: WO2012/130350

PCT Pub. Date: Oct. 4, 2012

(65) Prior Publication Data

US 2014/0000335 A1 Jan. 2, 2014

(30) Foreign Application Priority Data

Mar. 30, 2011 (DE) ..... 10 2011 015 570

(51) Int. Cl.
*B21D 7/024* (2006.01)
*B21F 1/00* (2006.01)

(52) U.S. Cl.
CPC ..... *B21D 7/024* (2013.01); *B21F 1/00* (2013.01)

(58) Field of Classification Search
CPC ..... B21F 1/00; B21F 1/006; B21D 11/12; B21D 7/024; B21D 7/022
See application file for complete search history.

(56) References Cited

U.S. PATENT DOCUMENTS

| | | | | |
|---|---|---|---|---|
| 3,894,422 | A * | 7/1975 | Peddinghaus | B21D 11/12 72/217 |
| 4,456,036 | A | 6/1984 | Rossi | |
| 4,718,265 | A * | 1/1988 | Post | 72/217 |
| 6,029,494 | A | 2/2000 | Wu | |
| 2005/0210945 | A1 | 9/2005 | Maier et al. | |
| 2007/0079642 | A1 * | 4/2007 | Bibeau et al. | 72/307 |
| 2009/0126438 | A1 | 5/2009 | Etienne | |
| 2010/0307213 | A1 | 12/2010 | Veit et al. | |

FOREIGN PATENT DOCUMENTS

| | | | |
|---|---|---|---|
| DE | 35 46 448 | A1 | 9/1986 |
| EP | 0 079 587 | A1 | 5/1983 |
| EP | 1 535 675 | A1 | 6/2005 |
| EP | 1 591 174 | B1 | 5/2008 |
| EP | 2 258 494 | A1 | 12/2010 |
| WO | WO 2007/122346 | A1 | 11/2007 |
| WO | WO 2010/080522 | A2 | 7/2010 |

* cited by examiner

*Primary Examiner* — Shelley Self
*Assistant Examiner* — Mohammad Yusuf
(74) *Attorney, Agent, or Firm* — Christensen Fonder P.A.

(57) ABSTRACT

In a bending head for bending rod-shaped and tubular workpieces, with a retainer that can be rotated about a rotational axis and that carries a bending mandrel at one axial end, and with at least two further tools, which each comprise a retaining body with, at its axial end facing the bending mandrel, a bending pin and which can each be rotated—in each case independently of the other tools—the retaining bodies of the tools are arranged concentrically to the retainer of the bending mandrel and pivotable about its rotational axis.

19 Claims, 5 Drawing Sheets

FIG. 3
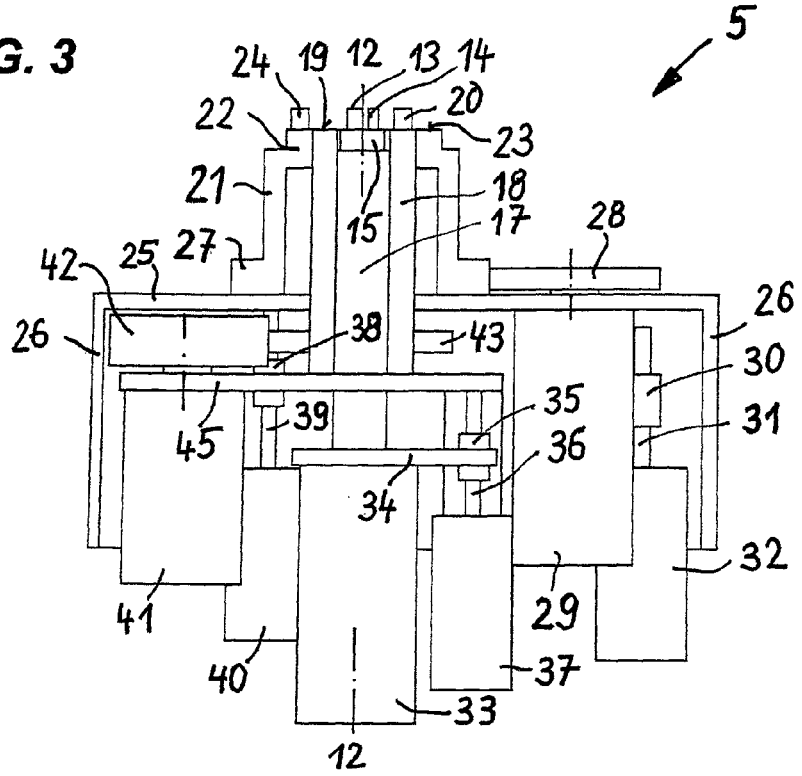
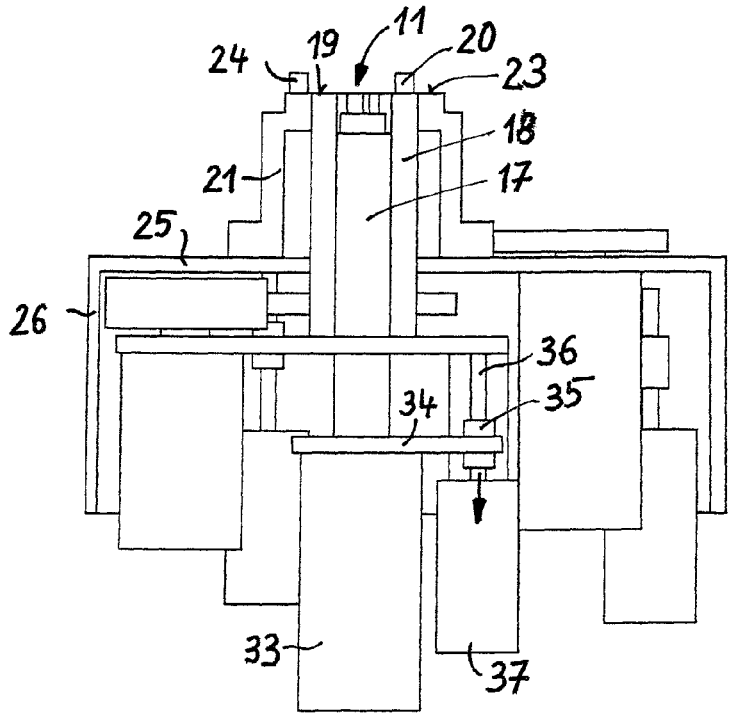
FIG. 4

BENDING HEAD FOR BENDING ROD- AND PIPE-SHAPED WORKPIECES

PRIORITY CLAIM

The present application is a National Phase entry of PCT Application No. PCT/EP2012/000144, filed Jan. 13, 2012, which claims priority from German Application Number 102011015570.8, filed Mar. 30, 2011, the disclosures of which are hereby incorporated by reference herein in their entirety.

FIELD OF THE INVENTION

The invention relates to a bending head for bending rod-shaped and tubular workpieces.

BACKGROUND OF THE INVENTION

From EP 1 591 174 B1, a bending head for a bending apparatus for rod-shaped and tubular workpieces is known, in which the workpiece is clamped between a central bending mandrel and a clamping device movable relative to the latter, and is bent by pivoting the bending mandrel and the clamping device while the workpiece is clamped. This known bending head functions with several rotational axes, one of which serves to rotate the bending mandrel, while another is allocated to the pivoting of the clamping device. A further rotational axis is provided for bringing about a clamping movement by radially advancing the clamping device towards the workpiece (or back). Although this known bending machine allows a bending of the workpiece in two opposite bending directions without changing the bending head, its structure is very complicated and it is not very flexible when a bending mandrel is used once fitted, wherein complex components are also not producible.

From WO 2007/122346 A1, a bending machine for rod-shaped and tubular workpieces is known which has a bending head with a circular disc which carries a bending mandrel in its centre and can be pivoted about a central bending axis. A clamping jaw is further provided which is attached, rotatable about a second axis, to the circumference of a rotary disc which, for its part, can be rotated on the circular disc about an axis parallel to the central bending axis and attached at a distance from the latter. With this known bending head, a bending of tubular workpieces with very thin walls can be carried out in two bending directions without a large outlay, wherein however, here too, the bending of very complex bending parts is not possible.

WO 2010/080522 A2 describes a bending head of the type named at the beginning. This known bending head can function with two or more tools which are attached to a rotary disc, on which a bending mandrel sits in the centre, around this bending mandrel and at a distance from it and are formed rotatable independently of one another by their own rotary drives. This known bending head also allows the production of complicated bending shapes, but its overall structure is very complex with, at the same time, a very large space requirement.

Starting from this, the task of the invention is to further develop such a known bending head in such a way that it has a greatly reduced space requirement and a less elaborate structure, while retaining its suitability for producing very complex bending parts.

SUMMARY OF THE INVENTION

A bending head for bending rod-shaped and tubular pieces has a retainer that can be rotated about a rotational axis and that carries a bending mandrel at one axial end, and with at least two further tools, which each comprise a retaining body with, at its axial end facing the bending mandrel, a bending pin and which can each be rotated independently of the other tools. In embodiments of the invention, the retaining bodies of the tools are arranged concentrically to the retainer of the bending mandrel and pivotable about its rotational axis.

The retaining bodies of the tools may be formed as hollow shafts running concentrically in one another, in the radially innermost of which the retainer of the bending mandrel sits, rotatable.

A feature and advantage of embodiments of the invention where the arrangement of the retaining bodies of all the tools and of the bending mandrel concentrically inside one another results in a telescope-like overall arrangement with minimal space requirement, which is also promoted by the fact that every tool consists of a retaining body with a bending pin protruding at its radial end face. Since, as a rule, its diameter is not very large, the wall thickness of the retaining body to which the bending pin is secured can likewise also be designed relatively small in radial direction, with the result that, in conjunction with the concentric arrangement of the retaining bodies and of the bending mandrel, as a whole a very much smaller space requirement results for the bending head according to the invention than in the case of the generic bending head.

Because the retaining bodies of the individual tools and the retainer of the bending mandrel are rotatable, in each case independently of one another, the bending mandrel and the bending pins can be rotated correspondingly independently of one another during operation, wherein a rotation in both rotational directions is possible for each of these elements. If, in addition to the bending mandrel, only two other tools are also present here in the bending head according to embodiments of the invention, these three individual elements arranged concentrically in one another, taking into account the two possible rotational directions of each of same, make it possible to achieve an extremely large number of different configurations of bending mandrel and bending pins relative to one another, resulting in remarkably great flexibility. At the same time, the production of very complex bending parts is possible.

If, in a bending head according to the invention, the retaining bodies of the tools are formed as hollow shafts running concentrically in one another, the retainer of the bending mandrel rotatably sits in the radially innermost of these, a quite particularly small space requirement of the bending head according to the invention is thereby achieved without any limitation of its flexibility.

An advantageous embodiment of the bending head according to the invention also consists in the bending mandrel and/or the bending pins being adjustable between an active operating position, in which it acts on the workpiece to be bent during the bending process, and an inactive rest position parallel to the rotational axis of the bending mandrel. It is thereby achieved that, in addition to the rotational movements that they can carry out, parts of the bending head can also be lowered, which means that the tool collars (single or multiple, independently or together) or the bending mandrel can be lowered below the bending plane and can be raised again e.g. on the other side of an inserted workpiece. Similarly, it is thereby also possible, when carrying out a quite particular bending process, to withdraw a bending pin that is not needed for this bending process from the bending plane by lowering its retaining body, with the result that it cannot disrupt the downstream bending process there.

In a further advantageous embodiment of the invention, it can also be provided that attached to at least one bending pin there is a bending roller that is freely rotatable about the latter, with the result that the bending process can be carried out by roll bending, which is desirable in particular in the case of larger diameters of the workpieces to be shaped.

It is furthermore preferred if, in a bending head according to the invention, the retaining body of the tool with the radially outermost bending pin is attached rotatably to an upper end wall of a housing and is in drive connection with a first rotary drive secured to this housing, in particular to its upper end wall. The retaining body of the tool with the radially outermost bending pin preferably has external teeth, preferably close to the upper surface of the end wall of the housing, which are in toothed engagement with a toothed wheel connected to the first rotary drive, wherein, again preferably, the first rotary drive, on the side of the upper end wall of the housing facing away from the bending pins of the tools, is secured to the latter. In this embodiment, the driving toothed wheel driven by the rotary drive for the retaining body of the tool with the radially outermost bending pin which meshes with external teeth of this retaining body is thus attached to the outside of the housing (via the upper end wall), while the first rotary drive driving it is arranged inside, thus on the other side of the upper end wall, and is preferably secured to the latter, wherein the drive shaft of this first rotary drive is fed through the upper housing wall in order to drive the driving toothed wheel. This also results in a relatively small space requirement of a bending head equipped in such a way.

A quite particularly great flexibility of the bending head according to the invention can be achieved in that the retainer for the bending mandrel and, likewise, the retaining bodies for the further tools are in each case attached to a rotary drive of their own, with the result that a complete independence from one another of their movements can be achieved.

Furthermore, it is advantageous if the first rotary drive is attached to a first lifting device which is formed for stationary assembly on a machine frame of a bending device and, once it is fitted there, allows the whole bending head with all the devices allocated to it to be moved parallel to the bending axis.

Advantageously, in a bending head according to the invention, the retaining body of each tool is attached to a device, by means of which it can be moved from an inactive rest position into an active operating position (and vice versa), which allows each of the tools used to be moved into or out of the bending plane.

It is furthermore particularly advisable in the case of the invention if the bending mandrel is secured to its retainer and the tools are secured to their retaining bodies interchangeably, with the result that a rapid exchange of the bending mandrel and/or the bending pins on the tools can also be carried out without great difficulty and with only a short machine stoppage.

An advantageous embodiment of the invention also results if at its axial end opposite the bending mandrel the retainer of the bending mandrel is attached to a second rotary drive which is secured to a first plate which, for its part, can be moved by means of a second lifting drive together with the second rotary drive and the retainer for the bending mandrel in the direction of the rotational axis of the latter.

A preferred embodiment of the bending mandrel according to the invention also consists in the first lifting drive comprising, on the drive side, a spindle shaft to which a spindle nut secured to the first plate is attached, wherein the spindle shaft is housed with its axially protruding end area in a second plate at a distance from the first plate, rotatable, but stationary in the axial direction of the spindle shaft, and the second plate carries the retaining body, surrounding the bending mandrel, of the tool for the radially innermost bending pin at its axial end facing away from the bending mandrel, rotatable relative to it, but stationary in the direction of the rotational axis. This embodiment results in the possibility of shifting the retaining unit for the radially innermost bending pin relative to the bending mandrel and the retainer of the latter in the longitudinal direction of the rotational axis of the bending mandrel in order to thus lower in particular the bending pin while keeping the bending mandrel in the bending plane or to lower the bending mandrel while keeping the innermost bending pin in the bending plane.

For this purpose, the second lifting drive preferably comprises, on the drive side, a spindle shaft on which a spindle nut secured to the first plate sits, wherein the spindle shaft is housed with its axially protruding end area in a second plate at a distance from the first plate, rotatable, but stationary in the axial direction of the spindle shaft, and the second plate carries the retaining body, surrounding the bending mandrel, of the tool for the radially innermost bending pin at its axial end facing away from the bending mandrel, rotatable relative to it, but held stationary in the direction of the rotational axis. In an otherwise identical embodiment, the spindle shaft of the second lifting drive here could, however, also be housed with its axially protruding end area on the housing, instead of on the second plate, rotatable, but housed stationary in its axial direction, whereby it can be achieved that an independent adjustment of first and second plate is then possible.

Advantageously, the second plate also carries a third rotary drive by means of which the retaining unit for the radially innermost bending pin can be driven in the rotational direction. This makes it possible to attach the drive for the retaining unit for the radially innermost bending pin inside the whole device, in a particularly space-saving manner.

A third lifting drive is preferably also provided by means of which the second plate can be shifted longitudinally in the direction of the rotational axis of the bending mandrel.

It is furthermore advantageous if, in the invention, all rotary drives and lifting drives are covered by a housing that is open towards the bottom, on the upper end wall of which the bending head protrudes outwardly.

The third lifting drive is preferably provided, on the drive side, with a spindle shaft on which a spindle nut connected to the second plate sits, wherein the spindle shaft, at its axially protruding end, is secured, rotatable, but stationary in the axial direction of the spindle shaft, to the upper end wall of the housing. In this embodiment, again in a very space-saving manner, a relative movement in the direction of the rotational axis of the bending mandrel can be achieved between the retaining unit for the radially inner bending pin and the retainer for the radially outer bending pin (in the case of two tools in addition to the bending mandrel).

In the bending head according to the invention, the bending mandrel can be formed in any suitable manner, but is preferably a multi-radius tool or a four-pin tool.

DESCRIPTION OF THE DRAWINGS

The invention is explained in principle in even more detail below with the help of the drawings by way of example. There are shown in:

FIG. 3 is a schematic, partly cut, representation of a bending head according to the invention with all lifting and rotary devices in the case of a bending mandrel with two further tools, wherein here the bending mandrel and the bending pins lie together in one bending plane;

FIG. 4 is the representation from FIG. 2, but with the bending mandrel lowered downwards from the bending plane;

DETAILED DESCRIPTION

Figure 1:
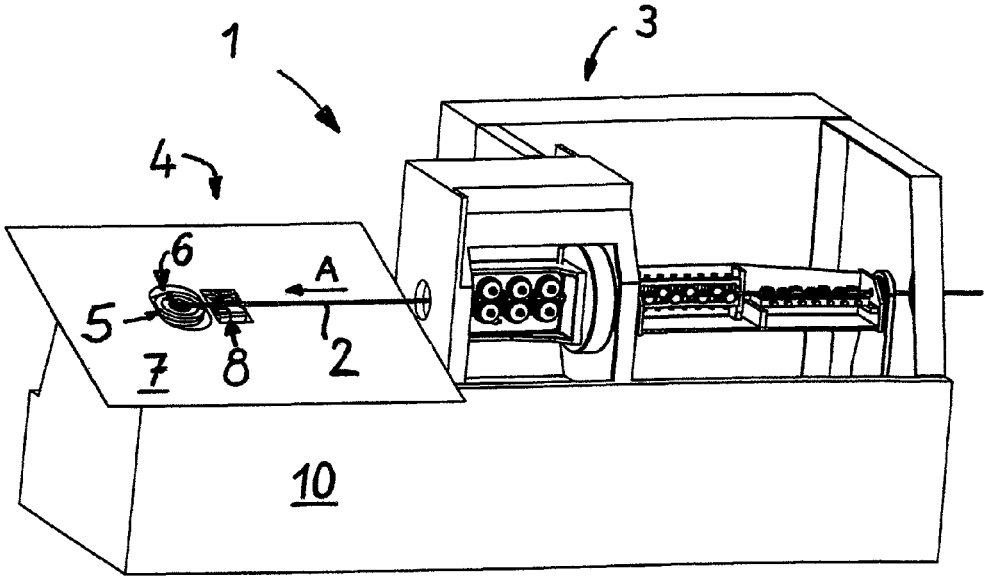
FIG. 1 is a perspective schematic diagram of a bending device with a bending head according to the invention.

FIG. 1 shows, in a quite basic oblique view, a bending machine 1 for processing rod-shaped or tubular workpieces 2, which comprises a feed and straightening unit 3 as well as a bending unit 4 which is attached after the feed and straightening unit 3 in the direction of feed.

The bending unit 4 comprises a bending head 5 which is attached inside a recess 6 in a bending table 7.

The workpiece 2 is fed in, in the direction of the arrow A, by the feed and straightening unit 3 firstly to a guiding device 8, upstream of the bending head 5, in which a cutting device 9 (FIGS. 1 and 2) is also provided.

Bending table 7 as well as feed and straightening unit 3 sit on a lower frame 10. The bending table 7 is arranged at an angle to the mounting base in order to make it possible for the workpiece 2 to slide down after processing. However, no device is shown in FIG. 1 for receiving the processed workpieces 2 sliding down.

Figure 2:
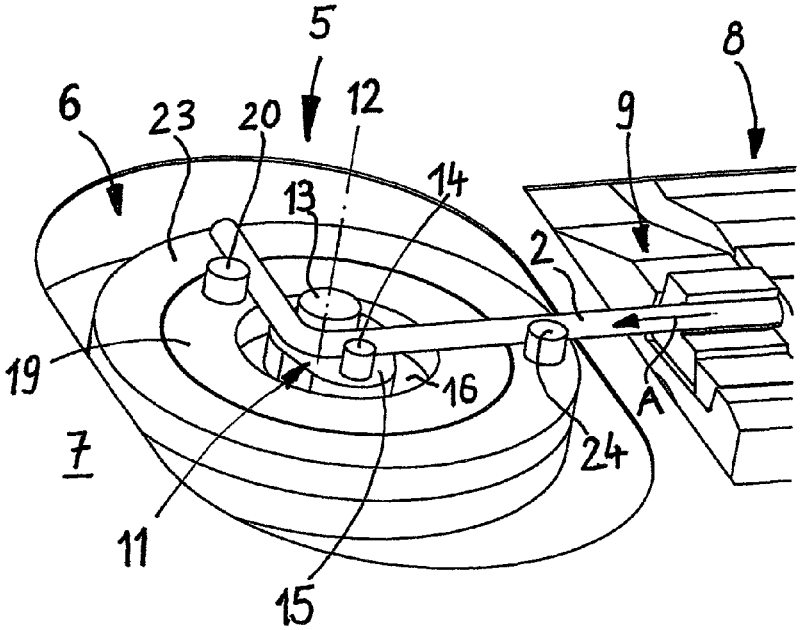
FIG. 2 is an enlarged representation of the bending area with the bending head according to the invention in the bending device according to FIG. 1.

The bending head 5 represented in FIG. 2 in an enlarged detail from FIG. 1 has a centrally arranged bending mandrel 11 which is designed as a two-pin tool in the embodiment shown and comprises, at its upper radial end face, two bending pins 13, 14 diagonally offset relative to each other by 180°. The bending pin 13 has a larger diameter than the bending pin 14, with the result that the two bending pins 13, 14 provide two different bending radii. The two bending pins 13, 14 form, together with a shaping base 15, a shaping mandrel as bending mandrel 11, wherein the shaping base 15, on its outer circumferential surface, likewise forms two circumferential surfaces diametrically opposite one another which in turn have two further bending radii. During the bending process, the workpiece 2 can be bent round the two bending surfaces of the shaping base 15 of the bending mandrel 11 either, as can be seen from FIG. 2, in the upper area of the bending mandrel 11 by the action of the bending pins 13, 14 or also in a plane lying underneath. Depending on which of the two bending planes the workpiece 2 is to be bent on, the bending mandrel 11 is moved, parallel in the direction of its rotational axis 12, such that either the two bending pins 13, 14 or the shaping base 15 are or is located in the bending plane.

The bending mandrel 11 sits on the upper axial end face 16 of a cylindrical retainer 17, as can be seen from FIGS. 3 to 6, which illustrate in each case a schematic, partially cut representation of such a bending head 5.

The central cylindrical retainer 17 of the bending mandrel 11, for its part, sits, as FIGS. 2 to 6 show, rotatable inside a retaining unit 18 formed as a hollow shaft which carries, on its upper axial end face 19 allocated to the bending mandrel 11, a bending pin 20 protruding axially from this end face (cf. FIGS. 2 and 3).

The retaining unit 18 which, with the bending pin 20, forms a tool, for its part, sits, again rotatable, inside an outer retaining unit 21 which, as FIG. 3 shows, is likewise formed as a hollow shaft.

The retaining unit 21 lying radially outside on the bending head 5 forms, at its upper area, a section 22 set back radially, in which the retaining unit 18 is housed rotatable and to the axial upper end face 23 of which an axially projecting bending pin 24 is again attached.

In the representation shown in FIG. 2, the surface of the shaping base 15, from which the bending pins 13 and 14 project, and the axial end face 19 of the retaining unit 18 and end face 23 of the retaining unit 21 are located in a continuous plane, wherein the bending of the workpiece 2 is carried out in this bending plane and thus, with respect to the bending mandrel 11, in its upper bending plane in cooperation with the bending pins 13 and 14.

The specific alignment of the bending head 5 from FIG. 2 is also represented in FIG. 3.

Reference may now be made to the representations of FIGS. 3 to 6, in which the concentric arrangement in one another of the outer retaining unit 21, the central retaining unit 18 and the inner cylindrical retainer 17 for the bending mandrel 11 is represented, wherein reference is made explicitly to the graphic representations of FIGS. 3 to 6.

The outer retaining unit 21, which carries the radially outer bending pin 24, is attached to the upper end wall 25 of a housing 26 open towards the bottom, namely such that it is attached rotatable relative to the latter, but immovable in the direction of the rotational axis 12.

On its lower section lying directly above the upper end wall 25 of the housing 26, the retaining unit 21 is provided with external teeth 27, not represented in more detail in FIGS. 3 to 6, which engage with a toothed wheel 28 likewise represented only schematically in FIGS. 3 to 6. Instead of being connected to the second plate 45, the rotary spindle 36 could be connected to its protruding axial end but also on the housing 26, rotatable, but stationary in the direction of its longitudinal axis, wherein in this case the first plate 34 and the second plate 45 are in each case vertically adjustable completely independently of one another.

The toothed wheel 28 is driven by a first rotary drive 29, secured on the opposite side of the end wall 25 to the latter, to which the toothed wheel 28 is connected through the end wall 25.

The first rotary drive 29 is connected by means of a spindle nut 30 secured to it to a rotary spindle 31 which, for its part, is secured at its lower end to a stationary machine housing, for instance the lower frame 10 of the bending table 7. During the rotation of the rotary spindle 31, the first rotary drive 29 together with the housing 26 and the retaining unit 21 secured to the latter and thus also the whole bending head can be moved parallel to the rotational axis 12 by the first lifting drive 32.

As FIGS. 3 to 6 further show, the cylindrical retainer 17 for the bending mandrel 11 is connected at its axial (lower)

end opposite the latter to a second rotary drive 33 which, for its part, is secured at its axial end facing the retainer 17 to a first plate 34.

Furthermore, a spindle nut 35 which engages with a rotary spindle 36 that, for its part, is driven by a second lifting drive 37 is connected to the first plate 34.

At its axial end opposite the second lifting drive 37, the rotary spindle 36 is connected to a second plate 45, namely in such a way that it is housed rotatable relative to the latter, but cannot be moved relative to the second plate 45 in the longitudinal direction of the rotary spindle 36. Instead of being connected to the second plate 45, the rotary spindle 36 could be connected to its protruding axial end but also on the housing 26, rotatable, but stationary in the direction of its longitudinal axis, wherein in this case the first plate 34 and the second plate 45 are in each case vertically adjustable completely independently of one another.

As FIGS. 3 to 6 show, the second plate 45 is moreover connected to the axially lower end face of the central retaining unit 18 in such a way that the latter is housed rotatable on the second plate 45, but cannot be moved relative to the second plate 45 in the longitudinal direction of the rotational axis 12.

The cylindrical retainer 17, running inside the retaining unit 18 formed as a hollow shaft, for the bending mandrel 11 runs through a corresponding opening (not shown in the figures) through the second plate 45 freely rotatable up to the first plate 34 which is attached beneath the second plate 45.

The second plate 45, on its side opposite the rotary spindle 36 with respect to the retaining unit 18, is attached to a further spindle nut 38 which meshes with a rotary spindle 39 which can be driven at its lower end by a third lifting drive 40. At its opposite axial (upper) end, the rotary spindle 39 is secured on the underside of the end wall 25 of the housing 26, namely rotatable relative to the latter, but not movable relative to the end wall 25 in the direction of the longitudinal axis of the rotary spindle 39. Through this arrangement, there now exists the possibility of moving the spindle nut 38 and thus the second plate 45 in the longitudinal direction of the rotary spindle 39 (accordingly parallel to the direction of the rotational axis 12) by activating the third lifting drive 40, and thereby shifting the central retaining unit 18 (with the bending pin 20 carried by it), the central retainer 17 and the bending mandrel 11 in the direction of the rotational axis 12.

Furthermore, a third rotary drive 41 is also secured stationary with its upper end to the second plate 45 on the same side of the second plate 45 on which the latter is attached to the spindle nut 38. Through the second plate 45, the third rotary drive 41 can drive an upper toothed wheel 42 lying above it, which engages with a toothed wheel 43 (or external teeth formed there) secured, rotationally fixed, to the retaining unit 18, with the result that the central retaining unit 18 can be driven in the rotational direction via the third rotary drive 41.

The central retaining unit 18 which, with the bending pin 20 carried by it, forms a first tool (the outer retaining unit 21, with the bending pin 24 carried by it, forms a second tool) can thus be rotated via the third rotary drive 41 relative to the central retainer 17 and to the outer retaining unit 21 and raised and lowered by means of the third lifting drive 37 by shifting the second plate 45.

The central retainer 17 with the bending mandrel 11 attached to its upper end is driven via the second rotary drive 33 in the rotational direction and can be shifted relative to the second plate 45 parallel to the alignment of the rotational axis 12 by activating the second lifting drive 37, and thus raised and lowered.

The alignment shown in FIG. 2 of the individual parts of the bending head 5 relative to each other is also given in the representation of FIG. 3.

In FIG. 4, the bending head 5 from FIG. 3 is now shown, wherein here the spindle nut 35 runs downwards on the rotary spindle 36 by actuating the second lifting drive 37, takes the first plate 34 downwards with it and, as a result, the second rotary drive 33 is also moved downwards on its top side with the cylindrical retainer 17 coupled to it together with the bending mandrel 11. A situation is thus achieved in which, as FIG. 4 shows, the bending mandrel 11 is lowered below the bending plane in which the axial end faces 19 and 23 of the retaining units 18 and 21 are located.

In this case, only the bending pins 20 and 24 protrude into the bending plane and can carry out the desired bending process there.

Figure 5:
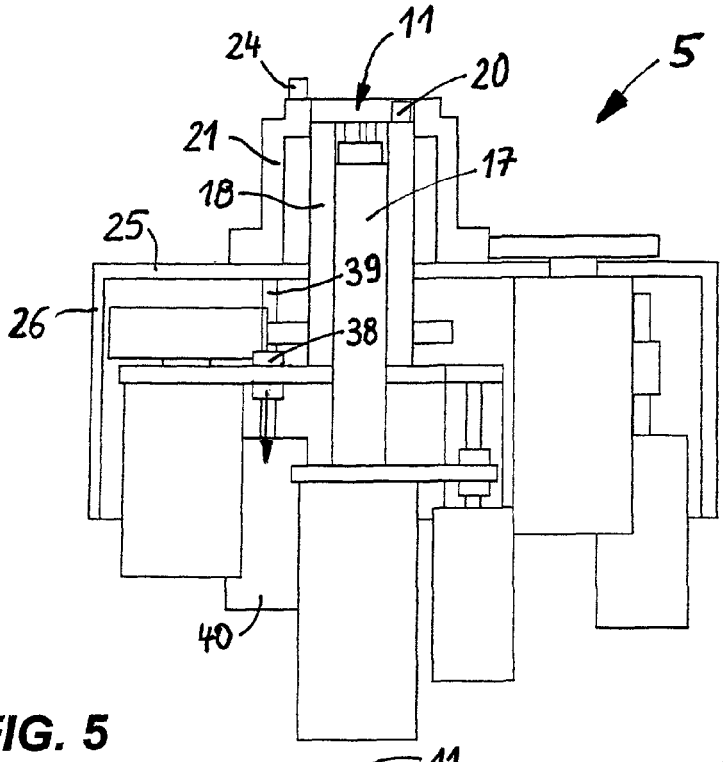
FIG. 5 is the bending head from FIG. 3, but with lowering of the bending mandrel and of the inner bending pin from the bending plane.

FIG. 5 now shows a setting of the bending head 5 in which the bending mandrel 11 has been lowered still further than in the position in FIG. 4 and in addition the central retaining unit 18 has likewise been lowered until the upper bending pin 20 of the central retaining unit 18 is lowered below the bending plane.

This is achieved in that, after reaching the position that is represented in FIG. 4, then (or simultaneously during the lowering of the central retainer 17 shown in connection with FIG. 4) by activating the third lifting drive 40 via its rotary spindle 39 the spindle nut 38 meshing with the latter and, with it, the second plate 45 with the central retaining unit 18 resting on it are driven downwards. In this way, by lowering the central retaining unit 18, the bending pin 20 carried by it is also withdrawn downwards from the bending plane, as FIG. 5 shows.

Thus, from now on, only the bending pin 24 is located at the top on the outer retaining unit 21 in the bending plane.

Figure 6:
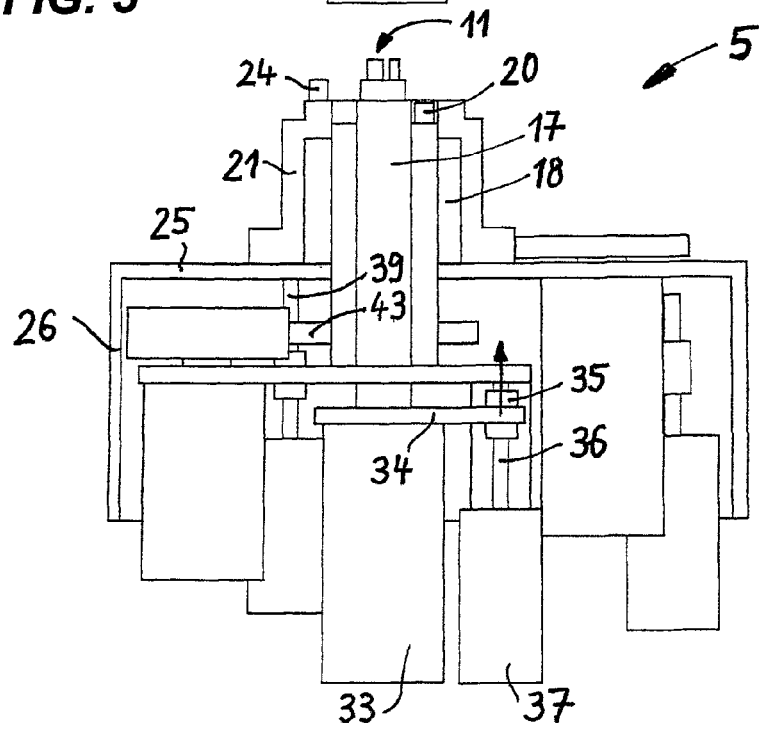
FIG. 6 is the representation from FIG. 5, but with a bending mandrel raised again, which is extended further than in FIG. 3, whereby work can be carried out in the lower plane of the bending mandrel, and with a lowered inner bending pin, as well as FIGS. 7-13 are in each case basic top views of a bending head according to the invention in the production of bending parts with varying degrees of complexity.

Finally, FIG. 6 shows the bending head 5 from FIG. 5, wherein the first plate 34 with the second rotary drive 33 and the central retainer 17 sitting on the latter is extended upwards with the bending mandrel 11 at its upper axial end in the direction of its rotational axis 12 from the position shown there from now on relative to the central cylindrical retainer 17 by activating the second lifting drive 37 in the opposite direction (compared with that for reaching the position in FIG. 4) via the rotary spindle 36 and the spindle nut 35 meshing with the latter. The bending mandrel 11 is raised so far that—as FIG. 6 shows—the shaping base 15 of the bending mandrel 11 is located in the bending plane and the bending pins 13 and 14 secured to it at the top lie outside the bending plane. In this way, there is the possibility of using the lower bending plane of the bending mandrel 11 in cooperation with the bending pin 24 at the top on the outer retaining unit 21 during the bending process.

Figure 7:
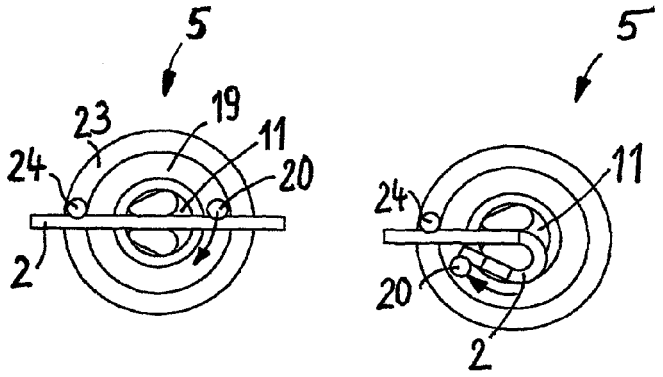
Figure 8:
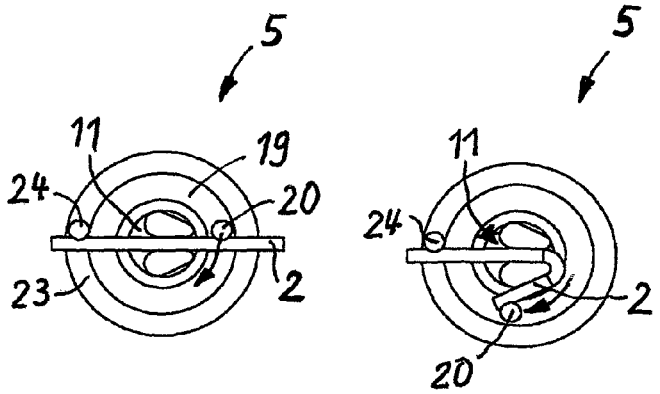

Different bending processes that can be carried out with the bending head 5 represented are now shown in FIGS. 7 to 13. Different bending mandrels 11 are used in the process, work is also carried out in different planes of the bending mandrel 11 and different bending processes are used:

FIGS. 7 and 8 show roll bending processes about a central shaping mandrel 11 which has different bending radii and wherein the radially inner bending pin 20 bends the workpiece 2 around a radius of the central bending mandrel 11, while the radially outer bending pin 24 acts as a counter retainer.

In FIG. 8 the end area of the workpiece 2 is again bent around the central bending mandrel 11 by the radially inner bending pin 20 by rotating its retaining unit 19, wherein the radially outer bending pin 24 again acts as a counter retainer.

Figure 9:
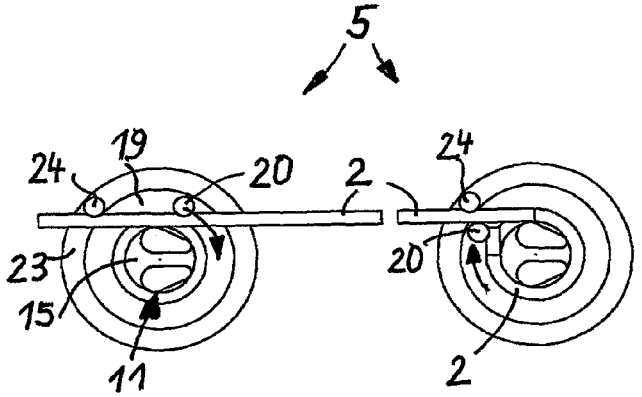

FIG. 9 shows an arrangement of the bending head 5, in which bending is carried out, no longer around the shaping flange of the bending mandrel 11, but in its lower bending plane around the shaping base 15, which has a circular bending radius in the embodiment of FIG. 9. Here too, the workpiece 2 is bent around the shaping base 15 of the bending mandrel 11 by rotating the retaining unit 19 carrying the inner radial bending pin 20, wherein the radially outer bending pin 24 again serves as a counter retainer for the workpiece 2 during bending.

Figure 10:
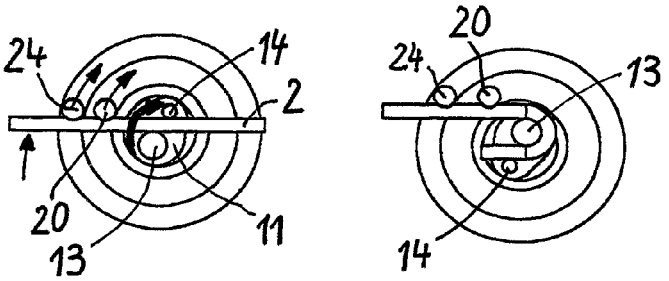
Figure 11:
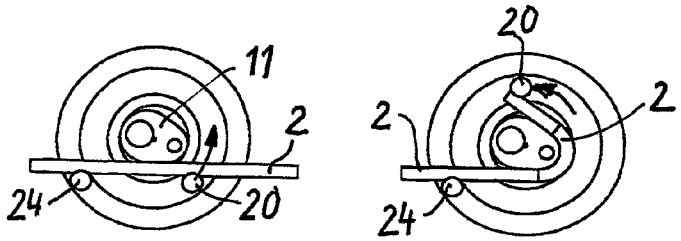

FIG. 10 shows a bending process in which the bending mandrel 11 is rotated and at the same time a compensating movement of the bending head 5 takes place, wherein here the bending pins 24 and 20 together serve as a counter retainer.

In the bending process represented in FIG. 11 the tool 2 is again bent on the bending mandrel 11 in its lower plane, wherein two bending radii are provided, as is shown directly from FIG. 11 by the representation of the bending mandrel 11.

Figure 12:
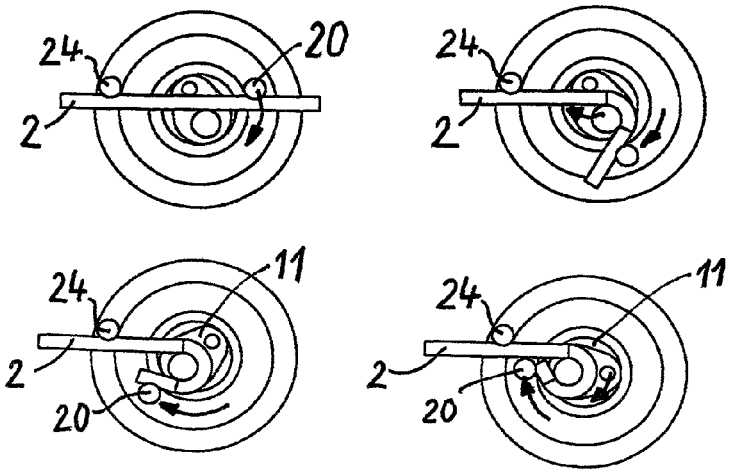

FIG. 12 shows four stages for rolling up the end of a workpiece 2 in which a straight end limb that is as short as possible is provided. For this, in the last two stages the bending mandrel 11 is rotated in addition to the movement of the bending pin 20 and thus the distance between bending pin 20 and bending mandrel 11 is reduced.

Figure 13:
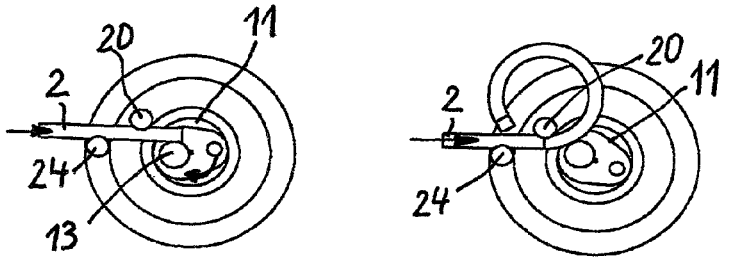

Finally, a winding process is shown in FIG. 13. The workpiece 2 is pushed forward and the bending mandrel 11 is placed against the workpiece 2 by rotation with its bending pin 13 of larger diameter. The two bending pins 20 and 24 serve as a counter retainer on both sides of the workpiece 2. With this process, larger bendings or helical parts can be produced, wherein the diameter of the product produced can also be altered by a rotation of the bending mandrel 11.

The lowering of a bending pin becomes necessary in the bending head 5 according to the invention whenever the latter has to be brought around below the workpiece 2 onto the other side thereof.

Thus if bending is to be carried out in the other bending direction, e.g. in FIG. 7, the bending pin 24 serving as counter retainer as well as the bending pin 20 that bends can be brought quickly below the workpiece 2 through onto the other side thereof. Likewise, the bending mandrel 11 can also be pulled, by the lowering movement possible therewith, out of the workpiece 2.

It can in principle also be provided that the whole of the bending head 5 according to the invention is attached e.g. also laterally (at right angles to the fed-in workpiece 2) movably to the machine frame (not represented in the figures). The flexibility of such a bending head 5 is thereby still further increased.

In the bending head 5 shown, the bending pins can be attached as rigid bending pins or as freely rotatable bending rollers. It is also possible to use bending pins in which a roller is attached to a rigid bending pin, rotatable around the latter. In the embodiment examples shown in the figures, however, only rigid bending pins are represented.

In addition, there is also the possibility, as likewise not shown in the figures, that the bending pins 20, 24 and the bending cam 11 are attached interchangeably to the respectively allocated retaining units 19 or 20 or to the retainer 17, with the result that they can be exchanged easily and quickly, if necessary.

The bending head 5 can be arranged with a perpendicular alignment of its rotational axis 12 on the allocated bending machine 1. As can be seen from FIGS. 1 and 2, however, the bending head 5 is often also incorporated with a degree of lateral tilt, in which the alignment of the rotational axis 12 relative to the perpendicular is arranged inclined at an angle, for instance at 20° to 30°, whereby, in particular also still in conjunction with a bending table 7 arranged at an angle, an easy withdrawal of the parts after processing by sliding is guaranteed.

The invention claimed is:

1. A bending head for bending rod-shaped and tubular workpieces, the bending head comprising:

a retainer with a bending mandrel at an axial end of the retainer, the retainer rotatable about a rotational axis, the bending mandrel comprising an axially extending bending pin; and a plurality of further tools, each of which comprises a retaining body with an axial end positioned at the bending mandrel axial end and a bending pin, and each of the plurality of further tools rotatable about the rotational axis and independently rotatable with respect to the retainer with the bending mandrel and with respect to each of the other plurality of tools, wherein a bending pin of one of the plurality of tools is positioned relative to the rotational axis such that the bending pin is displaced radially relative to the rotational axis and wherein the retaining body of said one of the plurality of tools is rotatably attached to an upper end wall of a housing, the retaining body is in drive connection with a first rotary drive secured to the housing, the retaining body has a lower section lying directly above the upper end wall of the housing, and the retaining body is provided with external teeth, the external teeth engaging a toothed wheel being driven by said first rotary drive, said first rotary drive being secured below the upper end wall and opposite to the toothed wheel, the toothed wheel being connected through the upper end wall to the rotary drive.

2. The bending head according to claim 1, wherein each of the retaining bodies of the plurality of further tools are formed as hollow shafts running concentrically in one another and wherein the retainer with the bending mandrel is radially innermost relative to the rotational axis.

3. The bending head according to claim 1 wherein at least one of the bending mandrel and the plurality of tools is axially moveable between an active operating position, in which the at least one acts on the workpiece to be bent during operation, and an inactive rest position parallel to the rotational axis of the bending mandrel.

4. The bending head according to claim 3, wherein all of the retaining bodies of each tool are attached to a device, by means of which each of said retaining bodies is adjustable from an inactive rest position into an active operating position and vice versa.

5. The bending head according to claim 1 further comprising a plurality of rotary drives and wherein the retainer with the bending mandrel and each of the retaining bodies of the plurality of the tools are in each case attached to an exclusive one of the plurality of rotary drives.

6. The bending head according to claim 5, wherein at least one of the plurality of rotary drives is attached to a first lifting device which is configured for stationary mounting on a machine frame of a bending device.

7. The bending head according to claim 1 further comprising a bending roller attached to one bending pin, the bending roller being freely rotatable about the bending pin.

8. The bending head according to claim 6, wherein the retainer of the bending mandrel is attached to an additional rotary drive which is secured to a first plate whereby the additional rotary drive is moveable by means of a second lifting drive together with the retainer for the bending mandrel in a direction of the rotational axis of the latter.

9. The bending mandrel according to claim 8, wherein the second lifting drive comprises, a spindle shaft to which a spindle nut secured to the first plate is attached, wherein the spindle shaft is housed with its axially protruding end area in a second plate at a distance from the first plate, rotatable, but fixed in an axial direction of the spindle shaft and the second plate carries the retaining body, surrounding the bending mandrel, of the tool for the radially innermost bending pin relative to the rotational axis at its axial end facing away from the bending mandrel, rotatable relative to the second plate, but fixed in the direction of the rotational axis.

10. The bending head according to claim 9, wherein the second plate also carries another rotary drive by means of which the retaining body for the radially innermost bending pin is rotatable in the rotational direction.

11. The bending head according to claim 10, wherein a third lifting drive is provided by means of which the second plate is shiftable longitudinally in the direction of the rotational axis.

12. The bending head according to claim 1, wherein the bending mandrel is interchangeably secured to the retainer whereby another mandrel may be attached thereto.

13. The bending head according to claim 1, wherein each of the bending pins of the plurality of further tools are interchangeable with a plurality of other bending pins.

14. The bending head according to claim 5, wherein all of the plurality of rotary drives are covered by the housing that is open towards the bottom, on the upper end wall of which the bending head protrudes outwardly.

15. The bending head according to claim 1, wherein the bending mandrel is formed as one of a multi-radius tool and a four-pin tool.

16. The bending head according to claim 1, wherein the bending head is configured to cooperate with a feed and straightening unit.

17. The bending head of claim 1, wherein the bending head is attached to abending machine comprising a feed and straightening unit.

18. A bending machine comprising a bending head for bending rod-shaped and tubular workpieces, the bending head comprising:

a retainer with a bending mandrel at an axial end of the retainer, the retainer rotatable about a rotational axis, the bending mandrel comprising an axially extending bending pin; and a plurality of further tools, each of which comprises a retaining body with an axial end positioned at the bending mandrel axial end and a bending pin, and each of the plurality of further tools rotatable about the rotational axis and independently rotatable with respect to the retainer with the bending mandrel and with respect to each of the other plurality of tools, wherein a bending pin of one of the plurality of tools is positioned relative to the rotational axis such that the bending pin is displaced radially relative to the rotational axis and wherein the retaining body of said one of the plurality of tools is rotatably attached to an upper end wall of a housing, the retaining body is in drive connection with a first rotary drive secured to the housing, the retaining body has a lower section lying directly above the upper end wall of the housing, and the retaining body is provided with external teeth, the external teeth engaging a toothed wheel being driven by said first rotary drive, said first rotary drive being secured below the upper end wall and opposite to the toothed wheel, the toothed wheel being connected through the upper end wall to the rotary drive.

19. The bending machine of claim 18, further comprising a feed and straightening unit attached to a bending unit comprising the bending head.

* * * * *